US008455750B1

(12) United States Patent
Severson

(10) Patent No.: US 8,455,750 B1
(45) Date of Patent: Jun. 4, 2013

(54) METHODS OF PROVIDING PICKUPS AND OTHER ACCESSORIES ON STRINGED INSTRUMENTS AND THE STRINGED INSTRUMENT

(76) Inventor: James L Severson, Coon Rapids, MN (US)

( * ) Notice: Subject to any disclaimer, the term of this patent is extended or adjusted under 35 U.S.C. 154(b) by 12 days.

(21) Appl. No.: 13/136,308

(22) Filed: Jul. 27, 2011

Related U.S. Application Data

(60) Provisional application No. 61/400,515, filed on Jul. 28, 2010.

(51) Int. Cl.
*G10H 1/32* (2006.01)
*G10H 3/00* (2006.01)

(52) U.S. Cl.
USPC ..... 84/743

(58) Field of Classification Search
USPC ..... 84/743
See application file for complete search history.

(56) References Cited

U.S. PATENT DOCUMENTS

| | | | | |
|---|---|---|---|---|
| 5,252,777 | A * | 10/1993 | Allen | 84/726 |
| 5,614,688 | A * | 3/1997 | Donnell | 84/743 |
| 5,637,823 | A * | 6/1997 | Dodge | 84/743 |
| 5,767,432 | A * | 6/1998 | Randolph | 84/743 |
| 6,253,654 | B1 * | 7/2001 | Mercurio | 84/267 |
| 6,278,059 | B1 * | 8/2001 | Lefton | 174/50 |
| 7,355,110 | B2 * | 4/2008 | Nash | 84/601 |

* cited by examiner

*Primary Examiner* — Jeffrey Donels
(74) *Attorney, Agent, or Firm* — Albert W. Davis, Jr.

(57) ABSTRACT

The invention provides a method of replacing, exchanging or repositioning pickups and other accessories used by stringed instruments from the back of the musical instrument.

18 Claims, 9 Drawing Sheets

METHODS OF PROVIDING PICKUPS AND OTHER ACCESSORIES ON STRINGED INSTRUMENTS AND THE STRINGED INSTRUMENT

CROSS-REFERENCE TO RELATED APPLICATIONS

This application claims priority to provisional patent application Ser. No. 61/400,515 filed Jul. 28, 2010 by Jim Severson for METHODS OF PLAYING A STRINGED INSTRUMENT AND THE STRINGED INSTRUMENT.

BACKGROUND OF THE INVENTION

The invention relates to the use of pickups and other accessories for a stringed instrument, such as electric hollow or solid body guitars, acoustic-electric guitars, electric bass guitars, electric violins, mandolins, ukuleles, and the like.

BRIEF SUMMARY OF THE INVENTION

The invention provides a method of replacing, exchanging or repositioning pickups and other accessories used by stringed instruments, such as electric solid body and hollow body (acoustic-electric) guitars, electric bass guitars, electric violins, mandolins, ukuleles, and the like.

A pickup is used to convert the oscillations of the strings into electrical impulses for subsequent conversion into sound.

It is often desirable to change the location or type of pickup in a guitar or other stringed instrument. The invention provides a method of quickly and easily installing or changing one or more pickups in a guitar.

The pickup or pickups are installed from the back of the guitar through an opening with a closure, cover or door. Various pickups and other accessories can easily be installed and removed in this method.

DETAILED DESCRIPTION OF THE INVENTION

Figure 1:
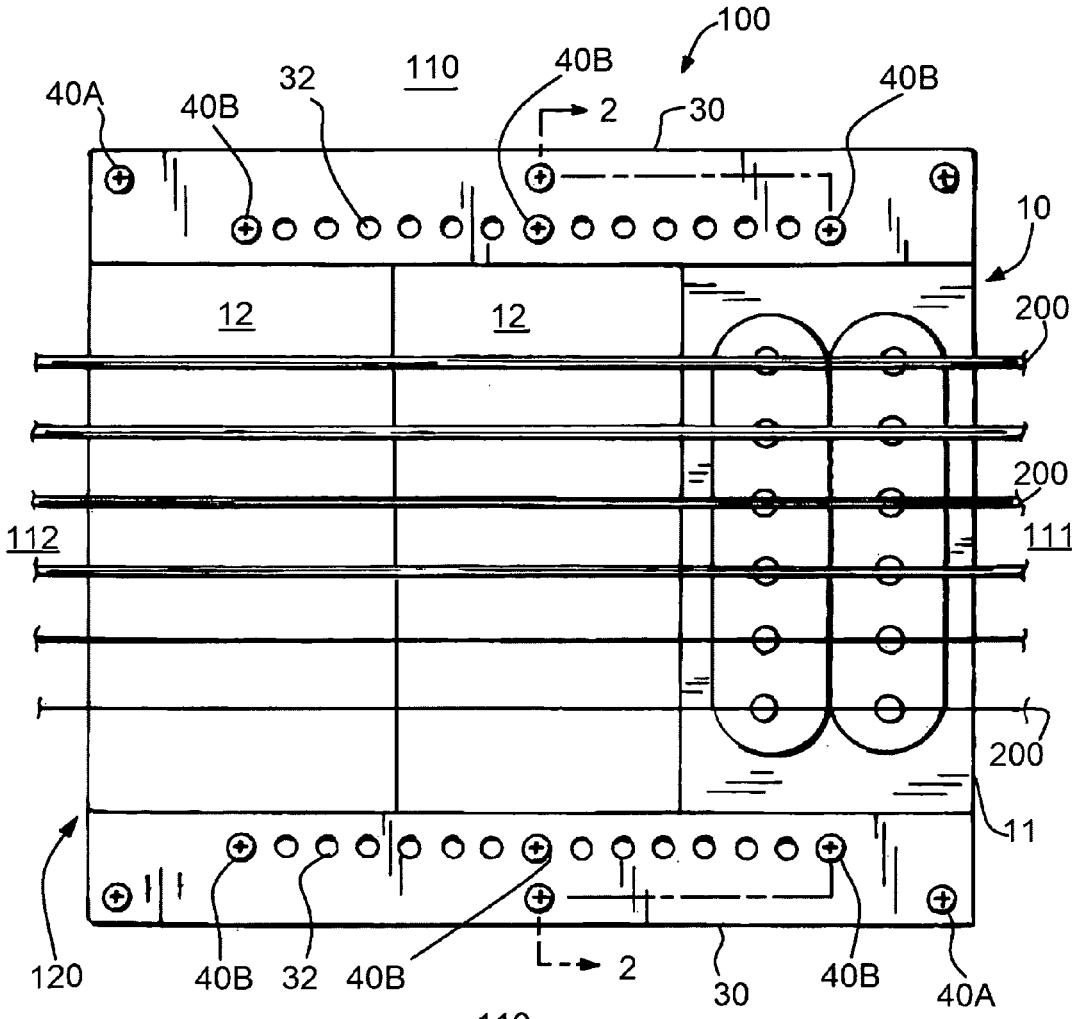
FIG. 1 is a top view of the invention.

FIG. 1 shows a portion of a stringed instrument 100, such as a guitar. The guitar 100 has a front body portion 110, strings 200 and a pickup 10 positioned beneath the strings. The guitar 100 is not fully shown. The bridge portion is to the left of the front body portion at 112, and the neck portion is to the right of the front body portion at 111. Pickup 10 has a mounting plate 11 and is mounted in the pickup cavity 120. Spacer plates 12 are provided to fill the opening in the pickup cavity 120 in the front body portion 110. Spacer plates 12 and mounting plates 11 are held in place by screws 40B or other type of fasteners passing through mating holes 32 in retainer plate 30 and secured in the guitar body. The fasteners can be plastic push-in friction fasteners, knurled or wing headed screws, etc.

Only one pair of screws or fasteners 40B need to be used to hold the spacer plates, accessory plates and mounting plates in position since the plates abut and are held in place by the guitar body at either the front right body portion 111 or the front left body portion 112.

The screws/fasteners 40B are shown holding each space plate 12 and mounting plate 11 in place; however only one set of screws/fasteners are needed if they are used to hold the spacer plate to the left in position. The other spacer plate and pickup plate are held in place by the left or neck portion of the guitar body. Alternatively, two plates could be held in place with the fasteners.

Figure 1A:
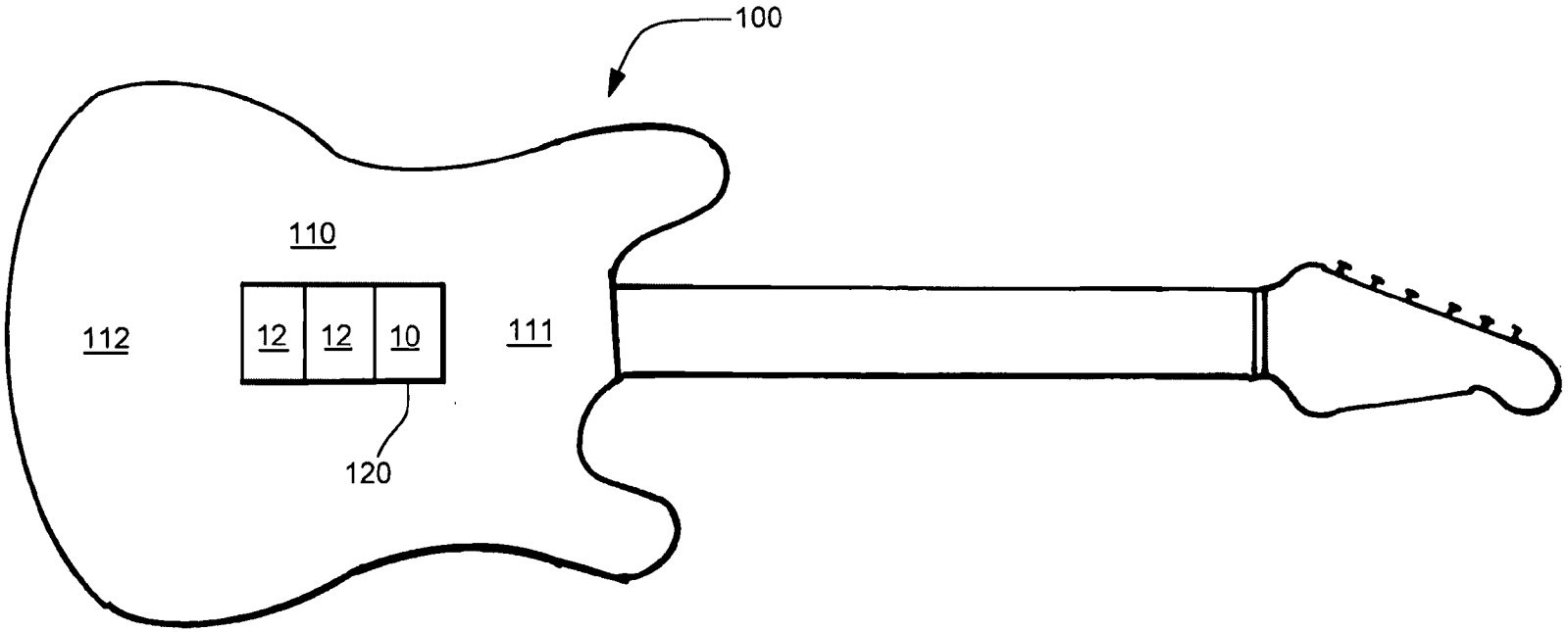
FIG. 1A is a top view of the invention.

FIG. 1A shows a guitar 100 with a front body portion 110, bridge portion 112 and a neck portion 111. The pickup cavity 120 has one pickup 10 and two spacer plates 12 in the shown variation of the invention.

Figure 2:
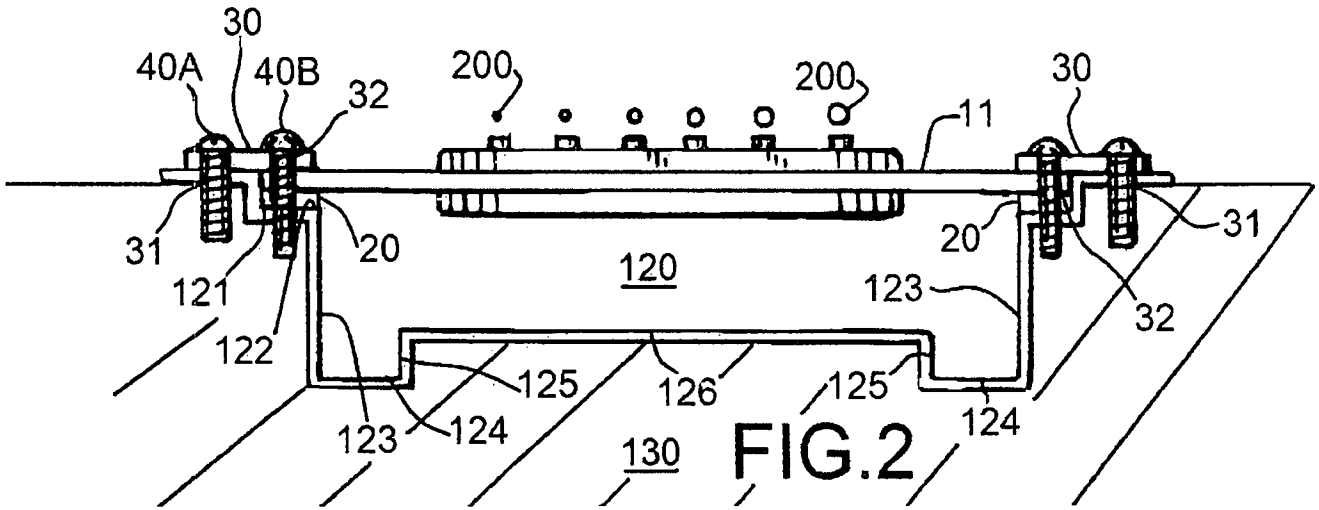
FIG. 2 is a cross-sectional view of the invention taken along doted line 2 in the direction of the arrows.

FIG. 2 shows the pickup cavity 120 formed in the guitar. Pickup cavity 120 provides an access for installing pickup 10 from the back body portion 130 of the guitar. Cavity 120 is provided in the guitar body to provide access to install and replace the pickups from the rear of the guitar. Cavity 120 is shown as having an inner guitar surface 121-126 which is shown as having a metal liner to provide an electromagnetic shield. The inner guitar surface has an outer wall 121, a ledge 122 upon which pickup mounting plate 11 slides and seats, an intermediate wall 123, a bottom wall 124, an inner wall 125 and a higher bottom wall 126.

A metal spacer of aluminum 20 is provided on the ledge 122 between the ledge and the metal of the pickup mounting plate 11 to provide a wear surface if the liner is a coating, thin foil or other material that may be worn away during the insertion and removal of the pickups, etc. The spacer 20 can be held in place on the ledge 122 by countersunk screws or other fastening means.

A retainer plate 30 holds the pickup 10 in place on the spacer 20 and ledge 122. The retainer plate 30 has holes 31 with screws 40A holding the plate to the guitar body. Retainer plate 30 also has holes 32 with screws 40B that hold the pickup mounting plate 11 to the retainer plate, the spacer 20 and the ledge 122. Spacer 20 has holes matching holes 32 in retainer plate 30. Screws 40B used in the holes 32 can be replaced by other types of fasteners, such as plastic Pine Tree® fasteners. The screws 40B are shown as going through the spacer 20 and into holes drilled into the guitar 100. Where the fasteners go into the guitar body, it is preferred to use a threaded insert attached to the guitar body to receive the screw.

The electromagnetic shield/liner on walls 121-126 of pickup cavity 120 and under the retainer plate 30 can be an electrically conductive paint, such as Stewart-Mac Donald Conductive Shielding Paint, sold by the Stewart-Mac Donald Company, Athens, Ohio. Other ways of lining the cavity are to provide copper or aluminum tape, a metal foil with glue, etc. The spacer 20 can be aluminum. The electrically conductive paint on the cavity 121-126, the metal spacer 20, the metal mounting plates 11 and/or spacer plates 12 provide an electrically conductive/shielded volume to suppress electromagnetic interference.

Figure 3:
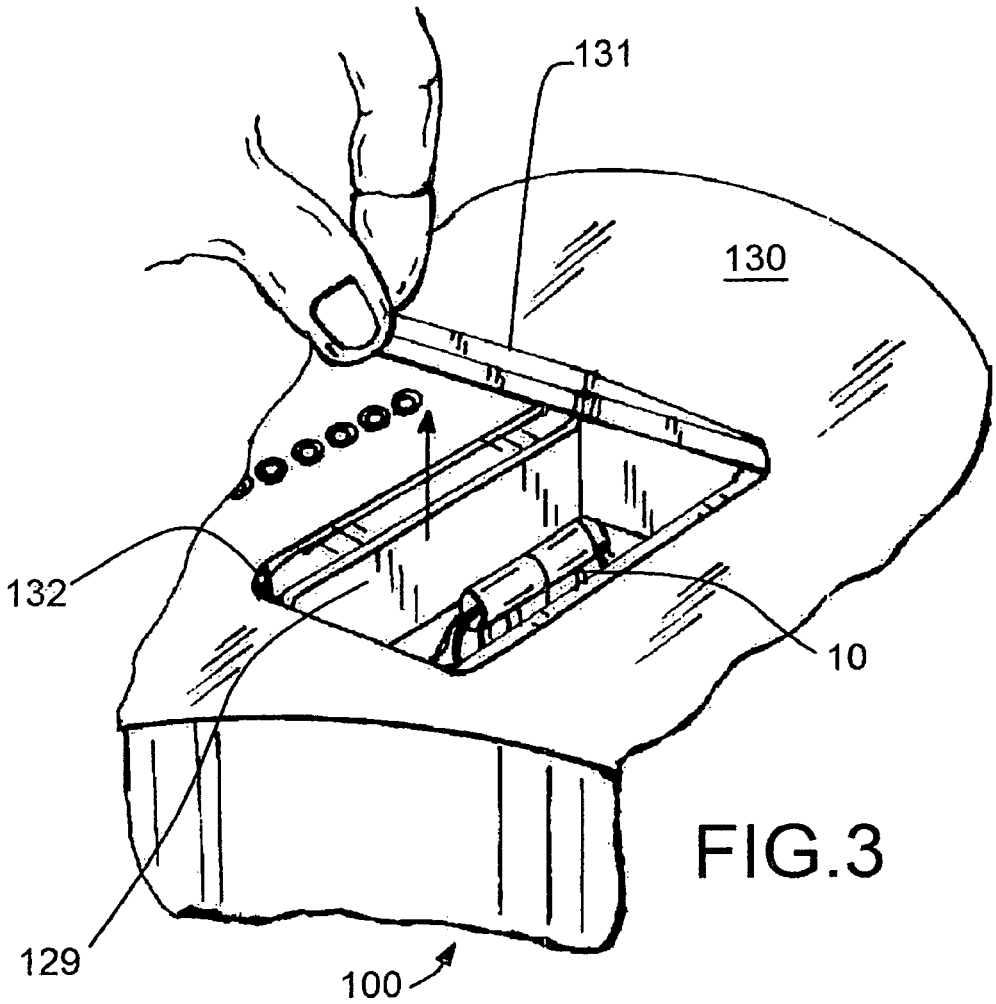
FIG. 3 is a perspective view of the back of the invention.

FIG. 3 shows the back body portion 130 of the guitar 100. The back body portion 130 has a cover plate 131 which provides access to the pickup cavity 120 through an opening 132 in the back portion of the guitar. The cover plate 131 is opened in the direction of the arrow. The cover plate 131 can be magnetically mounted to the back portion of the guitar. The cavity 120 has end wall 129.

To remove the pickup 10, the cover plate 131 is removed. The screws 40B or other fasteners, such as Pine Tree® or Christmas Tree® fasteners are removed from the retainer plate 30. The electrical connectors are unplugged from the pickup. Then, each spacer plate 12 is removed through the opening 132 by sliding it along the spacer 20 on ledge 122 until it reaches the opening 132 and is then removed through the opening 132. Then, the pickup mounting plate 11 is slid along the spacer 20 on ledge 122 until it reaches the opening 132 in the back portion of the guitar and then is removed through the opening 132.

To install the pickup, the pickup mounting plate 11 is introduced through the opening 132 and slid along the spacer 20 on ledge 122 until it reaches the front body portion 111 at one end of the ledge 122. The spacer plates 12 are then added to close the open space to the left of the pickup and secured with fasteners 40B. Cables are connected to the pickup before introducing the pickup 10 into cavity 120. The cable connections are covered in FIG. 6.

Opening 132 extends across the cavity 120 from the outer wall 121 to the opposing outer wall 121. The spacer 20 is also missing at the opening 132. Therefore, the pickup mounting plate 11 can be removed from the guitar through the opening 132. The dimensions of the opening 132 will be larger than the length of the mounting plate 11. The opening 132 can be larger than the width of the spacer plate 12 or the pickup mounting plate 11 so that different size plates can be introduced therethrough. The opening 132 can have various positions, such as right, left or center of the cavity 120 (normal bridge, middle and neck pickup positions).

Figure 4:
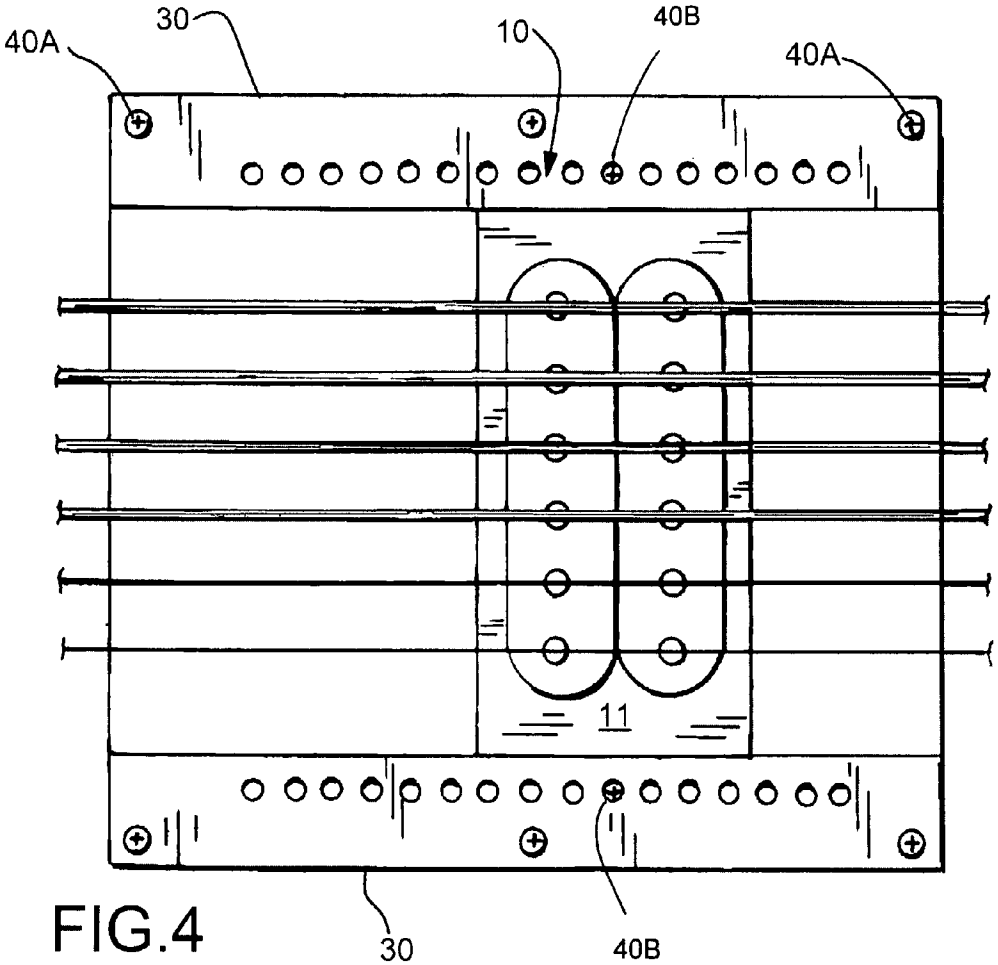
FIG. 4 is a top view of the invention.

FIG. 4 shows a pickup 10 mounted in a different position by removing screws 40B, removing the spacer plates 12 if present, sliding the pickup mounting plate 11 to the new position and then repositioning one set of screws or other type of fastener 40B in the retainer plate 30 and mounting plate 11. In this embodiment, the electromagnetic shielding can be provided by using shielded pickups.

Figure 5:
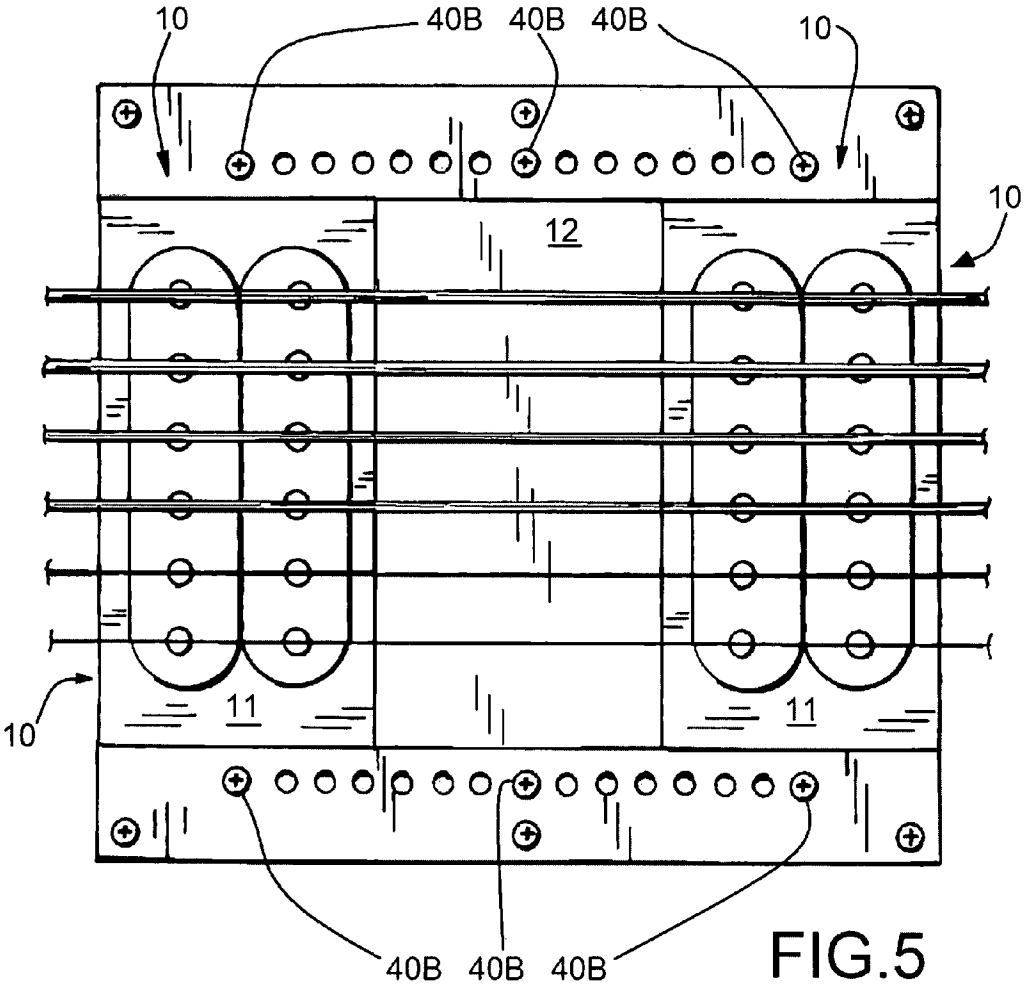
FIG. 5 is a top view of the invention.

FIG. 5 shows two pickups 10 mounted on either side of a spacer plate 12 on the guitar by screws or fasteners 40B. Only one set of fasteners 40B need be used. The fasteners 40B would be used in the pickup plate or spacer plate at the end of the guitar having the opening 132.

Figure 6:
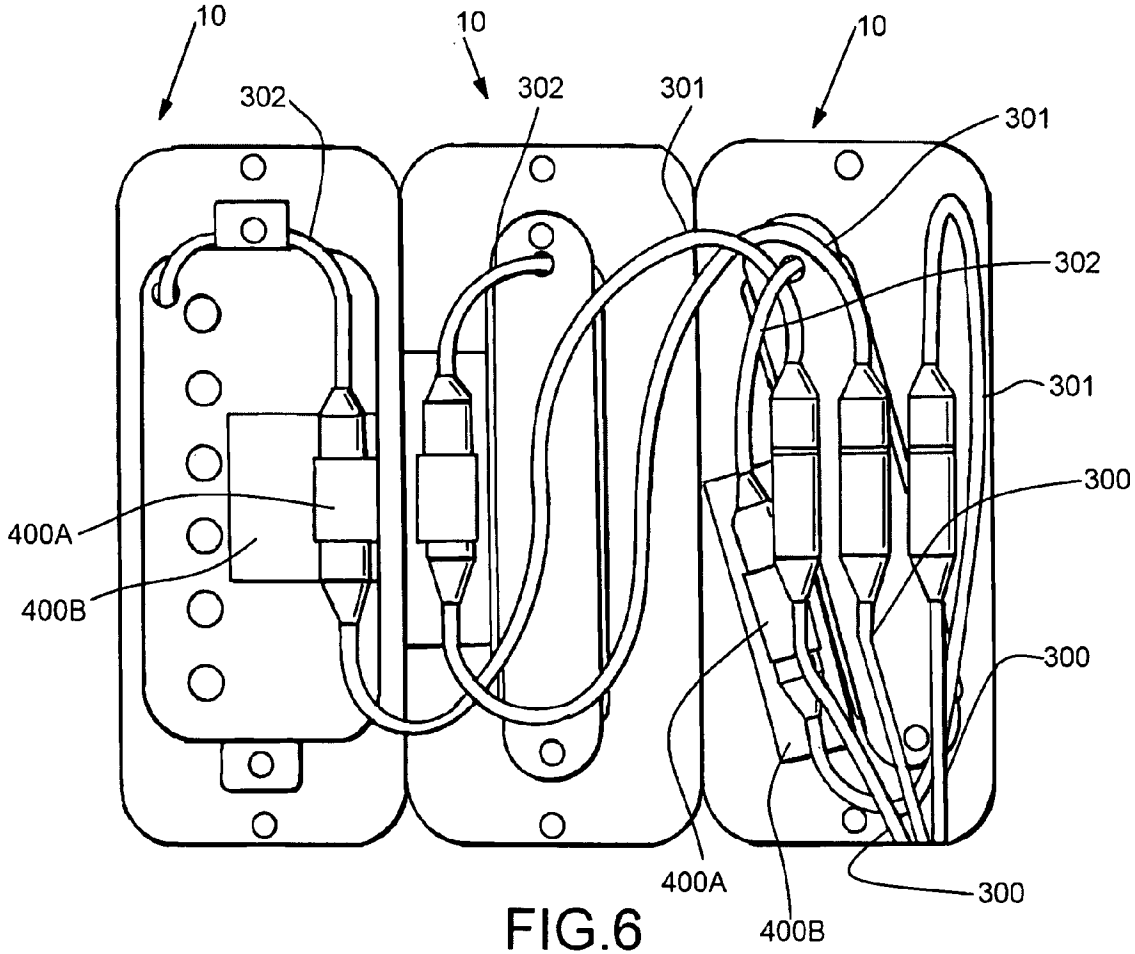
FIG. 6 is a bottom view of the invention.

FIG. 6 shows multiple, different pickups can be used at the same time on the guitar, such as three or more pickups. For example, the pickups could be a Humbucker™ neck (rhythm) pickup, a single coil middle pickup and an angled "stacked" Humbucker™ bridge (lead) pickup of single coil width.

Control cavity electrical cables 300 which are fed through a hole into the control cavity (not shown) connect to intermediate cables 301 with female and male ends which connect to the pickup cables 302 on the pickups. Intermediate cables 301 extend pickup cables 302 and are easily connected to cables 300 and 302. The control cavity cables 300 connect to controls in the control cavity.

Optionally, hook and loop fasteners 400A,B can be added to the cables 301 and/or 302 and to the mounting plates 11 to hold the cables in place. Alternatively, only a single hook and loop fastener can be used at the opening 132 to secure all of the cables. The cables can be color or otherwise coded to provide easy matching of the corresponding/correct cables. The cables can have multi-pin, USB or other suitable connectors.

Connections between the pickup cables 302, 301 and the corresponding control cavity cables 300 are made in the opening 132 before the pickups are removed or after the pickups have been installed. The intermediate cables 301 are plugged into the pickup cables 302 before introducing the pickup 10 into the cavity 120.

Figure 7:
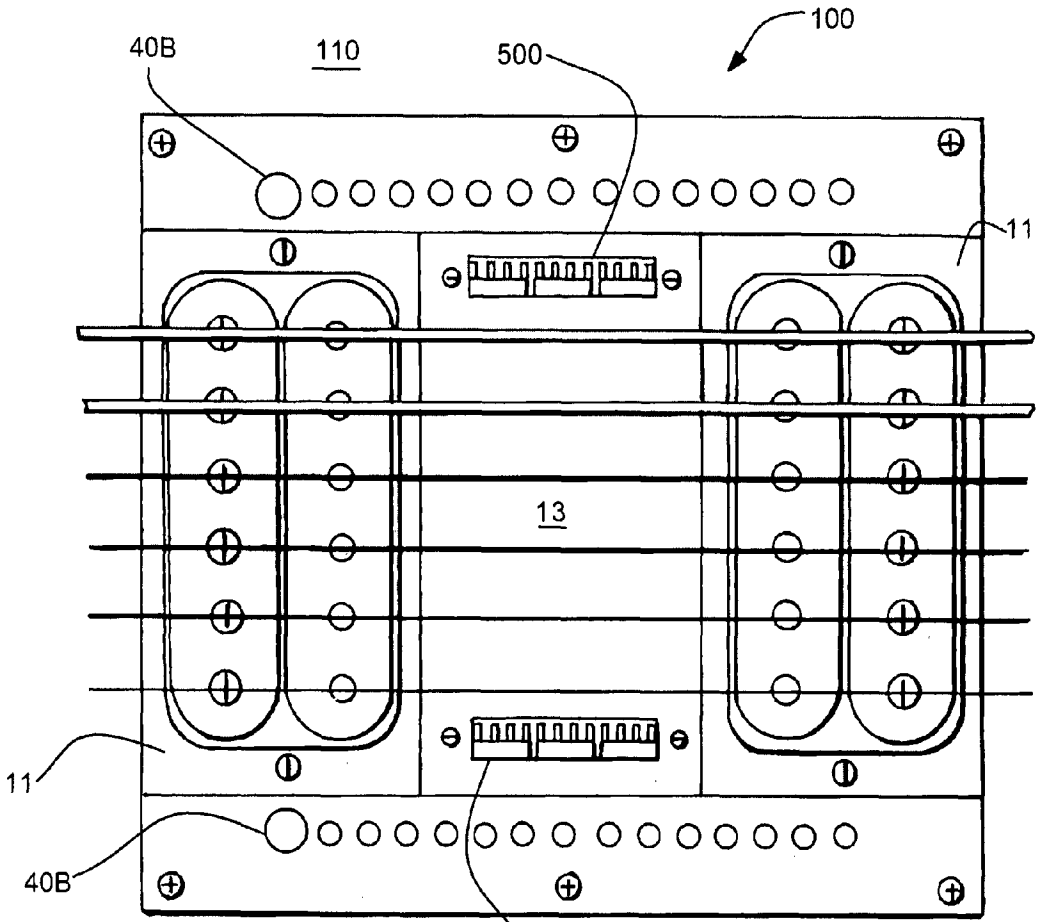
FIG. 7 is a top view of another embodiment of the invention.

FIG. 7 shows an accessory plate 13 with accessories 500, such as two rows of electrical slide switches, provided on the plate which is positioned between two pickup mounting plates 11. The plates 11,13 are all held in place by Pine Tree® fasteners 40B in the pickup plate on the left and the guitar body on the right.

The accessories/switches 500 which can alter the wiring configuration of dual coil pickups are mounted on a circuit board attached to the accessory plate 13 which may be electrically connected to the pickups by jacks on the circuit board.

Preferably, the switches can be connected to the pickups by using patch or connecting cables which would extend to the opening 132 for ease of connection at the point. The cables can be color or otherwise coded to help making the proper connections.

The accessory plate 13 can be provided in any unused position. The preferred position of the pickup switching accessory plate 13 is in the middle pickup position.

The accessory 500 on the accessory plate 13 may be an electronic processor with a touch or pressure sensitive display that may be patched through in a similar manner to switching plate.

The processor on the accessory plate can have reference software applications, such as a guitar tuner, a chord library, a scale library, etc.

Further, various software applications similar to those currently available for the iPhone® or iPod®, such as the Amplitube® 2,3 applications from ikmultmedia.com and the Guitar Toolkit® and other applications from agilepartners.com, may be incorporated through the use of the appropriately sized and modified processor with a display. The processor may be provided with cables to provide an output or be a wireless processor.

Wireless pickups incorporating radio transceivers may be mounted with pickup mounting plates thereby requiring no connecting cables and processed with a wireless processor mounted on an accessory plate or a wireless processor mounted in the control cavity.

Figure 8:
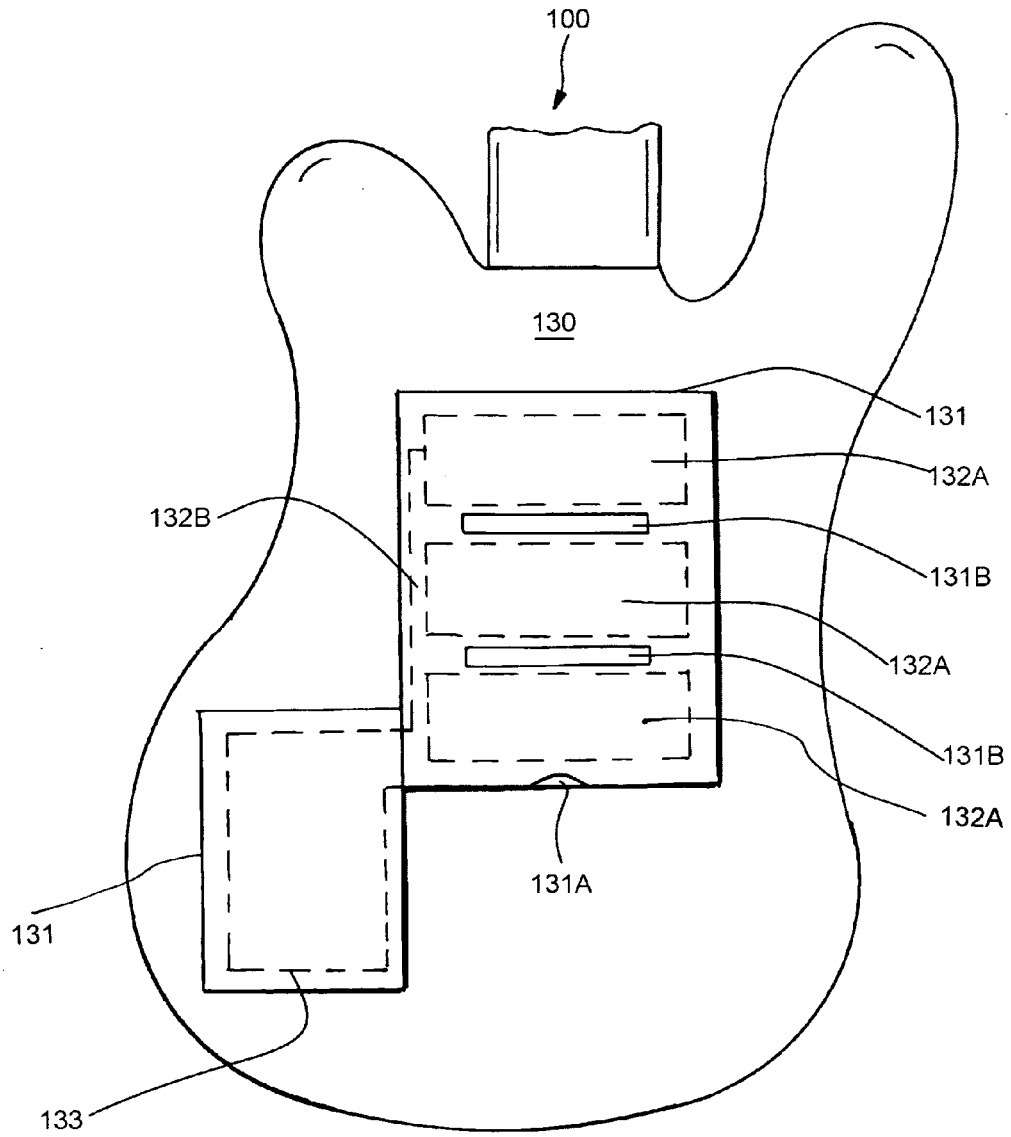
FIG. 8 is a bottom view of a further embodiment of the invention.

FIG. 8 shows an alternate embodiment of the invention in which the openings 132 A, B to the back of the guitar are divided into three compartments 132A for three pickups which are the pickup cavities in this embodiment and a compartment 132B for the wires or cables. Openings 132A extend through to the front of the guitar. The outlines of the opening 132A,B are shown in dotted lines since they are behind cover plate 131. The openings 132A,B are spaced from the cover plate 131 by enough distance to provide space for the wires or cables and the pickup mount fasteners.

Cover plate 131 has a coin slot 131A to help in removing the cover plate. Magnets 131B are mounted on the two walls separating the three compartments 132A for holding the cover plate 131 in place.

The control cavity 133 (shown in dotted lines) communicates with the compartments 132A,B to feeds the wires/cables to the pickups. The control cavity 133 can have any shape and has a cover plate 131 which can be held in place with magnets or other holding means. The control cavity 133 can contain a pickup selector, a volume control for each pickup, a tone control for each pickup, etc. Cables/cords will exit the guitar from the control cavity through a hole in the control cavity (not shown).

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

Various changes and modifications to the embodiments herein chosen for purposes of illustration will readily occur to those skilled in the art. For example, the pickups can be of various types and can be in any combination. The pickups can be electromagnetic, optical, active, passive, etc. The pickup cavity 120 may not need to be shielded if the pickups are shielded. A cosmetic plate can be attached to the retainer plate 30.

I claim:

1. A method of providing pickups to a stringed musical instrument comprising the following steps, providing a musical instrument having strings and a front and a back, providing the musical instrument with a cavity from the front under the strings to the back of the instrument, the cavity being larger in the front of the instrument than in the back of the instrument, providing a pickup having mounting means to mount the pickup in the cavity, positioning the pickup under the strings through the cavity in the back of the musical instrument by sliding the pickup along a ledge until it is in a proper position, mounting the pickup to the musical instrument, then providing a second pickup having mounting means to mount the pickup in the cavity, positioning the second pickup under the strings through the cavity in the back of the musical instrument by sliding the Pickup along the ledge until it is in a proper position and mounting the second pickup to the musical instrument.

2. The method of claim 1 including the following steps, providing the pickup on a mounting plate, providing mounting means on the mounting plate to mount the pickup mounting plate on the musical instrument and mounting the pickup mounting plate on the musical instrument.

3. The method of claim 1 including the following steps, providing a spacer plate, providing mounting means on the spacer plate to mount the spacer plate on the musical instrument and mounting the spacer plate on the musical instrument.

4. The method of claim 1 including the following steps, providing an accessory plate, mounting an accessory on the accessory plate, providing mounting means on the accessory plate to mount the accessory plate on the musical instrument and mounting the accessory plate on the musical instrument.

5. The method of claim 4 wherein the accessory is selected from the group consisting of a guitar tuner, an electrical switch and a processor with software applications.

6. The method of claim 1 including the step of shielding the cavity from electromagnetic energy.

7. The method of claim 1 including the following steps, providing a third pickup and positioning the third pickup under the strings by moving the pickup directly to its proper position.

8. A method of providing accessories to a stringed musical instrument comprising the following steps, providing a musical instrument having strings and a front and a back, providing the musical instrument with a cavity from the front under the strings to the back of the instrument, the cavity being larger in the front of the instrument than in the back of the instrument, providing an accessory having mounting means to mount the accessory in the cavity, positioning the accessory under the strings through the cavity in the back of the musical instrument by sliding the accessory along a ledge until it is in a proper position, mounting the accessory to the musical instrument, then providing a second accessory having mounting means to mount the accessory in the cavity, positioning the second accessory under the strings through the cavity in the back of the musical instrument by sliding the accessory along the ledge until it is in a proper position and mounting the accessory to the musical instrument.

9. The method of claim 8 wherein the accessory is selected from the group consisting of a pickup, a guitar tuner, an electrical switch and a processor with software applications.

10. The method of claim 8 including the following steps, providing the accessory on a mounting plate, providing mounting means to mount the accessory mounting plate on the musical instrument and mounting the accessory mounting plate on the musical instrument.

11. The method of claim 8 including the following steps, providing a spacer plate, providing mounting means to mount the spacer plate on the musical instrument and mounting the spacer plate on the musical instrument.

12. The method of claim 8 including the step of shielding the cavity from electromagnetic energy.

13. The method of claim 8 including the following steps, providing a third accessory and positioning the third accessory under the strings by moving the accessory directly to its proper position.

14. A method of providing accessories to a stringed musical instrument comprising the following steps, providing a musical instrument having strings and a front and a back, providing the musical instrument with a cavity from the front under the strings to the back of the instrument, the cavity being larger in the front of the instrument than in the back of the instrument, providing an accessory having mounting means to mount the accessory in the cavity, positioning the accessory under the strings through the cavity in the back of the musical instrument by sliding the accessory along a ledge until it is in a proper position, mounting the accessory to the musical instrument, then providing a second accessory having mounting means to mount the accessory in the cavity, positioning the second accessory under the strings through the cavity in the back of the musical instrument by moving the accessory directly to its proper position and mounting the second accessory to the musical instrument.

15. The method of claim 14 wherein the accessory is selected from the group consisting of a pickup, a guitar tuner, an electrical switch and a processor with software applications.

16. The method of claim 14 including the following steps,
providing the accessory on a mounting plate,
providing mounting means to mount the accessory mounting plate on the musical instrument and
mounting the accessory mounting plate on the musical instrument.

17. The method of claim 14 including the following steps,
providing a spacer plate,
providing mounting means to mount the spacer plate on the musical instrument and
mounting the spacer plate on the musical Instrument.

18. The method of claim 14 including the step of
shielding the cavity from electromagnetic energy.

* * * * *